US011410625B2

(12) United States Patent
Kim et al.

(10) Patent No.: US 11,410,625 B2
(45) Date of Patent: Aug. 9, 2022

(54) DISPLAY INTERFACE DEVICE CAPABLE OF REDUCING POWER CONSUMPTION

(71) Applicant: LG Display Co., Ltd., Seoul (KR)

(72) Inventors: Jin-Sung Kim, Gumi-si (KR); Gyeong-Hwan Kim, Jeongeup-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/089,487

(22) Filed: Nov. 4, 2020

(65) Prior Publication Data

US 2021/0049974 A1 Feb. 18, 2021

Related U.S. Application Data

(63) Continuation of application No. 16/219,304, filed on Dec. 13, 2018, now Pat. No. 10,861,407.

(30) Foreign Application Priority Data

Dec. 27, 2017 (KR) ..... 10-2017-0181378

(51) Int. Cl.

| | |
|---|---|
| ***G09G 3/36*** | (2006.01) |
| ***G09G 3/3275*** | (2016.01) |
| ***G09G 3/20*** | (2006.01) |

(52) U.S. Cl.

CPC ..... *G09G 3/3685* (2013.01); *G09G 3/2092* (2013.01); *G09G 3/3275* (2013.01); *G09G 2310/0289* (2013.01); *G09G 2310/08* (2013.01); *G09G 2320/0276* (2013.01); *G09G 2320/0673* (2013.01); *G09G 2320/103* (2013.01); *G09G 2330/021* (2013.01); *G09G 2330/022* (2013.01)

(58) Field of Classification Search

None

See application file for complete search history.

(56) References Cited

U.S. PATENT DOCUMENTS 8,643,583 B2 * 2/2014 Yoshida ..... G09G 5/39 345/98
2007/0063954 A1 * 3/2007 Huang ..... G09G 3/2092 345/98

(Continued)

FOREIGN PATENT DOCUMENTS

CN 101763837 A 6/2010
CN 102810294 A 12/2012

(Continued)

*Primary Examiner* — Amr A Awad
*Assistant Examiner* — Donna V Bocar
(74) *Attorney, Agent, or Firm* — Seed IP Law Group LLP

(57) ABSTRACT

A display interface device capable of reducing power consumption is disclosed. In the display interface device, a timing controller configured to compare input pixel data in horizontal line units and operate in a low power mode according to a result of comparison between an input time of horizontal lines having the same pixel data and a reference time in the horizontal line units. The timing controller operates in any one of a first low power mode for transmitting a training pattern and a second low power mode including a first duration during which data transmission and reception are stopped and a second duration during which the training pattern is transmitted, according to the result of comparison between the input time of horizontal lines having the same pixel data and the reference time.

11 Claims, 6 Drawing Sheets

(56) References Cited

U.S. PATENT DOCUMENTS

| | | | | |
|---|---|---|---|---|
| 2012/0242671 | A1 | 9/2012 | Wyatt | |
| 2013/0278569 | A1 | 10/2013 | Choi | |
| 2014/0085276 | A1* | 3/2014 | Jang | G09G 3/20 345/204 |
| 2015/0170598 | A1 | 6/2015 | Jeon et al. | |
| 2016/0307543 | A1 | 10/2016 | Lim | |
| 2017/0295343 | A1 | 10/2017 | Konishi et al. | |

FOREIGN PATENT DOCUMENTS

| | | | |
|---|---|---|---|
| CN | 103680392 | A | 3/2014 |
| CN | 104078016 | A | 10/2014 |
| CN | 104751810 | A | 7/2015 |
| CN | 102841671 | B | 9/2015 |
| CN | 105321479 | A | 2/2016 |
| CN | 105448225 | A | 3/2016 |
| CN | 106782403 | A | 5/2017 |

* cited by examiner

DISPLAY INTERFACE DEVICE CAPABLE OF REDUCING POWER CONSUMPTION

CROSS-REFERENCE TO RELATED APPLICATION(S)

This application is a continuation of U.S. patent application Ser. No. 16/219,304, filed Dec. 13, 2018, which claims the benefit of Korean Patent Application No. 10-2017-0181378, filed Dec. 27, 2017, which is hereby incorporated by reference as if fully set forth herein.

BACKGROUND

Technical Field

The present disclosure relates to a display interface device capable of reducing power consumption by operating in a low power consumption mode when a plurality of horizontal lines having the same data is input.

Description of the Related Art

A representative display device for displaying images includes a liquid crystal display (LCD) using liquid crystal, an organic light-emitting diode (OLED) display device using OLEDs, and an electrophoretic display (EPD) using electrophoretic particles.

A display device includes a panel for displaying an image through a pixel array, a panel driver for driving the panel, and a timing controller for controlling the panel driver. The panel driver includes a gate driver for driving gate lines of the panel and a data driver for driving data lines of the panel.

Typically, a system supplies all image information necessary for display to the timing controller in real time. The timing controller supplies all of the image information to the data driver. The data driver converts digital data received from the timing controller into analog data and outputs the analog data to the panel so that the panel may display images.

In this case, since the timing controller repeats the same operation even when the same data is input from the system and repeatedly supplies the same data to the data driver, unnecessary power is consumed. A method capable of reducing unnecessary power consumption would be beneficial.

BRIEF SUMMARY

Accordingly, the present disclosure is directed to a display interface device that substantially reduces one or more problems due to limitations and disadvantages of the related art.

In various embodiments, the present disclosure provides a display interface device capable of reducing power consumption by operating in a low power consumption mode when a plurality of horizontal lines having the same data is input.

Additional advantages, embodiments, and features of the disclosure will be set forth in part in the description which follows and in part will become apparent to those having ordinary skill in the art upon examination of the following or may be learned from practice of the disclosure. The embodiments and other advantages of the disclosure may be realized and attained by the structure particularly pointed out in the written description as well as the appended drawings.

To achieve these embodiments and other advantages and in accordance with the purpose of the disclosure, as embodied and broadly described herein, a display interface device includes a timing controller configured to compare input pixel data in horizontal line units and operate in a low power mode according to a result of comparison between an input time of horizontal lines having the same pixel data and a reference time in the horizontal line units, and data integrated circuits (ICs) configured to drive data lines of a display panel using transmission data received from the timing controller. The timing controller operates in any one of a first low power mode for transmitting a training pattern and a second low power mode including a first duration during which data transmission and reception are stopped and a second duration during which the training pattern is transmitted, according to the result of comparison between the input time of horizontal lines having the same pixel data and the reference time.

The timing controller may further include a transmitter for transmitting each packet including a delimiter, including a clock edge, and serial transmission data. Each of the data ICs may include a receiver for restoring the clock edge and the transmission data from each packet transmitted by the transmitter and generating an internal clock using the clock edge. The reference time may be set to a lock time corresponding to a minimum time needed when a clock generator installed in the receiver of each of the data ICs is restored from an unlock state to a lock state by the training pattern transmitted by the transmitter.

The timing controller may operate in the first low power mode when the input time of the horizontal lines having the same data is less than or equal to the lock time and operate in the second low power mode when the input time of the horizontal lines having the same data is greater than the lock time.

When the timing controller operates in the first low power mode, the timing controller may transmit pixel data of a first horizontal line among the horizontal lines having the same data and information about a duration of the horizontal lines having the same data to the data ICs and transmit the training pattern to the data ICs during a transmission duration corresponding to the other horizontal lines among the horizontal lines having the same data. A voltage swing level of the training pattern transmitted in the first low power mode may be set to be lower than a voltage swing level of a normal operation mode.

When the timing controller operates in the second low power mode, the timing controller may transmit the pixel data of a first horizontal line among the horizontal lines having the same data and information about a duration of the horizontal lines having the same data to the data ICs, turn off the transmitter during the first duration, and turn on the transmitter during the second duration following the first duration to transmit the training pattern to the data ICs. The second duration may be set to be longer than at least the lock time.

When the timing controller operates in the first low power mode or the second low power mode, the data ICs may store the pixel data of the first horizontal line received from the timing controller in a latch unit, convert the pixel data stored in the latch unit into analog data during a duration corresponding to the information about the duration of the horizontal lines having the same data, received from the timing controller, and output the analog data to the data lines.

When the timing controller operates in the second low power mode, the receiver of each of the data ICs may be turned off together with the transmitter during the first duration and may be turned on during the second duration.

When the timing controller operates in the first low power mode or the second low power mode, the timing controller may generate a synchronization signal synchronizing with a gate control signal and supply the synchronization signal to the data ICs. The data ICs may output the analog data during every horizontal period in synchronization with an edge at which the synchronization signal transitions.

The timing controller may configure the information about the duration of the horizontal lines having the same data by a control packet during a blank duration of a data enable signal and transmit the control packet to the data ICs.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Reference will now be made in detail to the exemplary embodiments of the present disclosure, examples of which are illustrated in the accompanying drawings. Wherever possible, the same reference numbers will be used throughout the drawings to refer to the same or like parts.

Figure 1:
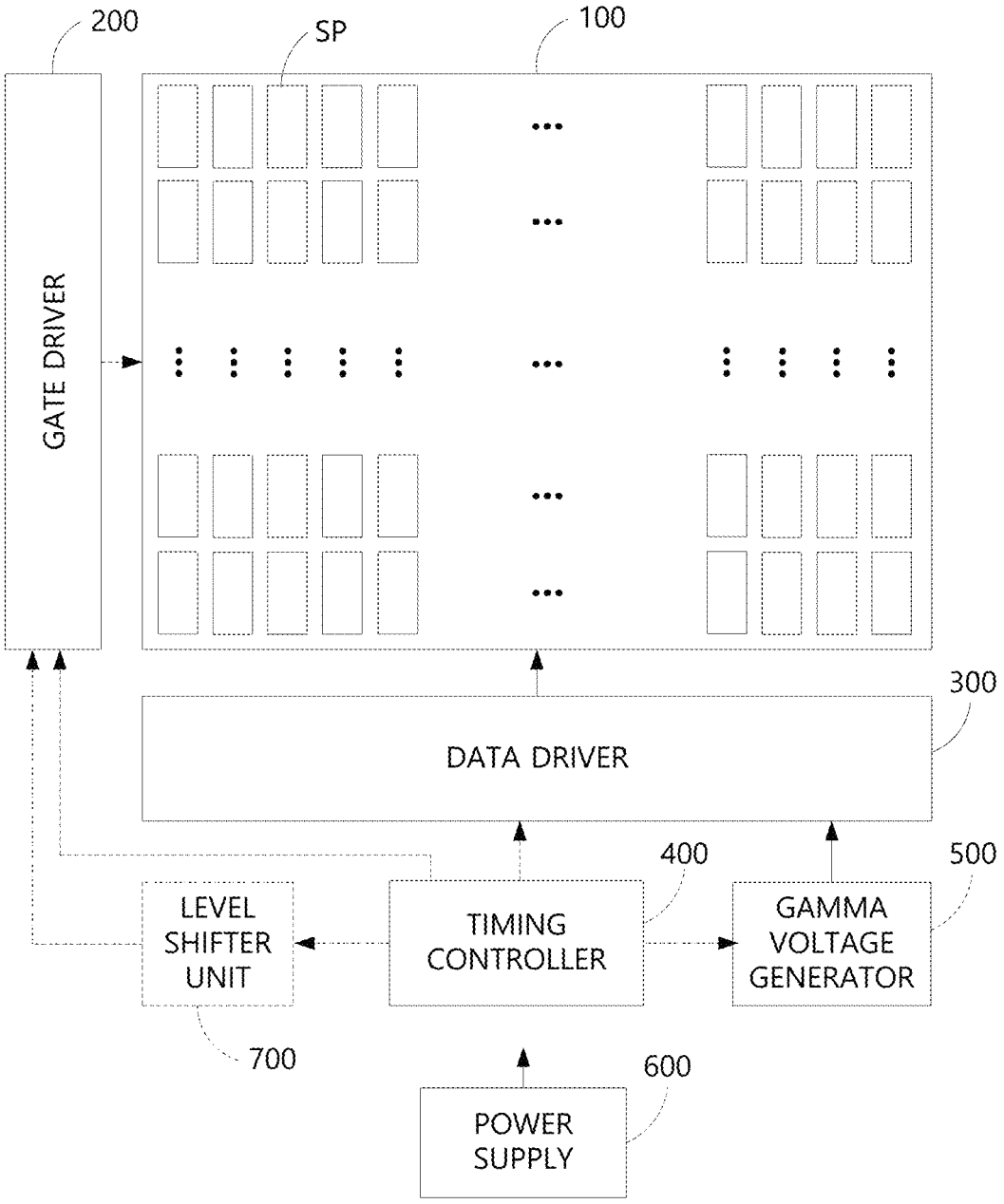
FIG. 1 is a block diagram schematically illustrating the construction of a display device according to an embodiment of the present disclosure.

FIG. 1 is a block diagram schematically illustrating the construction of a display device according to an embodiment of the present disclosure.

Referring to FIG. 1, the display device includes a panel 100, a gate driver 200, a data driver 300, a timing controller 400, a gamma voltage generator 500, and a power supply 600. The display device may further include a level shifter unit 700 according to a construction type of the gate driver 200.

The power supply 600 generates and outputs driving voltages needed for all circuit configurations of the display device, i.e., driving voltages necessary for operation of the panel 100, the gate driver 200, the data driver 300, the timing controller 400, the level shifter unit 700, and the gamma voltage generator 500, using an external input voltage. For example, the power supply 600 generates and outputs, using the input voltage, a digital block driving voltage supplied to the timing controller 400, the data driver 300, and the level shifter unit 700, an analog block driving voltage supplied to the data driver 300 and the gamma voltage generator 500, a gate-on voltage and a gate-off voltage supplied to the gate driver 200 and the level shifter unit 700, and driving voltages needed to drive the panel 100.

The panel 100 displays images through a pixel array including subpixels SP arranged in a matrix. A basic pixel may include at least three subpixels capable of expressing white by color mixture between white (W), red (R), green (G), and blue (B) subpixels. For example, the basic pixel may include R/G/B subpixels or W/R/G/B subpixels. The basic pixels may include R/G/B subpixels, W/R/G subpixels, B/W/R subpixels, or G/B/W subpixels.

The panel 100 may be one of various display panels such as an LCD panel and an OLED panel. The panel may be a touch display panel having a touch sensing function.

The gate driver 200 receives a plurality of gate control signals from the timing controller 400 or the level shifter unit 700 and performs a shift operation, thereby individually driving gate lines of the panel 100. The gate driver 200 supplies a scan signal of a gate-on voltage (or a gate-high voltage) to a corresponding gate line during a driving period of each gate line and supplies a scan signal of a gate-off voltage (or a gate-low voltage) to a corresponding gate line during a non-driving period of each gate line.

The gate driver 200 according to an embodiment is comprised of one or plural gate integrated circuits (ICs) individually mounted onto circuit films such as chip-on-films (COFs) so that the gate driver 200 may be bonded and connected to the panel 100 by tape automated bonding (TAB) or may be mounted on the panel 100 by a chip-on-glass (COG) method. The gate ICs constituting the gate driver 200 receive the plural gate control signals from the timing controller 400 and perform the shift operation, thereby sequentially driving the gate lines.

Meanwhile, the gate driver 200 according to an embodiment may be formed on a substrate together with a thin-film transistor (TFT) array constituting the pixel array of the panel 100 and may be embedded as a gate-in-panel (GIP) type into non-display region(s) of both side parts or one side part of the panel 100. The gate driver 200 of the GIP type receives the gate control signals from the level shifter unit 700 and performs the shift operation, thereby sequentially driving gate lines.

The level shifter unit 700 generates the plural gate control signals under control of the timing controller 400 and outputs the gate control signals to the gate driver 200. The level shifter unit 700 receives a plurality of control signals from the timing controller 400 and generates and outputs the plural gate control signals by logically processing and level-shifting the control signals received from the timing controller 400. For example, the level shifter unit 700 level-shifts and outputs a start pulse and a reset pulse received from the timing controller 400. The level shifter unit 700 receives an on-clock and an off-clock which are repeated in every horizontal period from the timing controller 400 and generates and level-shifts a plurality of scan clocks having different phases, which rise at a plurality of on-clock rising timings and fall at a plurality of off-clock falling timings, by logically processing the on clock and the off clock.

The timing controller 400 receives timing control signals and pixel data from a host system. The timing control signals include a dot clock, a data enable signal, a vertical synchronization signal, and a horizontal synchronization signal. The timing controller 400 generates a plurality of data control signals for controlling a driving timing of the data driver 300 using the timing control signals received from the system and timing configuration information stored therein and supplies the data control signals to the data driver 300. The timing controller 400 generates a plurality of gate control signals for controlling a driving timing of the gate driver 200 and supplies the gate control signals to the gate driver 200. Alternatively, the timing controller 400 generates a plurality of control signals for controlling the level shifter unit 700 and supplies the control signals to the level shifter unit 700.

The timing controller 400 performs a variety of image processing, such as luminance correction for reduction of power consumption or picture quality correction, with respect to the pixel data received from the system and supplies the image-processed data to the data driver 300.

Particularly, the timing controller 400 compares the pixel data received from the system in horizontal line units. If it is determined that lines having the same pixel data as a previous horizontal line are successively input, the timing controller 400 transmits the pixel data of the first line among the lines having the same data and stops transmitting data for the other lines, thereby operating in a low power mode and selectively applying a different low power mode according to a duration time of the lines having the same data. This will be described later in detail.

The timing controller 400 generates gamma data according to gamma characteristics of the display device and supplies the gamma data to the gamma voltage generator 500. If a frame frequency, an image mode, or an image characteristic is changed, the timing controller 400 may adjust a gamma characteristic curve, generate the gamma data according to the adjusted characteristic curve, and supply the gamma data to the gamma voltage generator 500.

The gamma voltage generator 500 generates a reference gamma voltage set including a plurality of different reference gamma voltages having different voltage levels and supplies the reference gamma voltage set to the data driver 300. The gamma voltage generator 500 may generate a plurality of reference gamma voltages corresponding to gamma voltage characteristics of the display device according to control of the timing controller 400 and supplies the reference gamma voltages to the data driver 300. The gamma voltage generator 500 receives gamma data from the timing controller 400, generates or adjusts a reference gamma voltage level according to the gamma data, and outputs the gamma data having the adjusted voltage level to the data driver 300.

The data driver 300 is controlled by the data control signals received from the timing controller 400. The data driver 300 converts digital pixel data received from the timing controller 400 into analog data signals and supplies the analog data signals to data lines of the panel 100, respectively. In this case, the data driver 300 converts the digital pixel data into the analog data signals using gradation voltages into which the plural reference gamma voltages received from the gamma voltage generator 500 are segmented and supplies the analog data signals to the data lines of the panel 100.

Particularly, when the timing controller 400 operates in a low power mode, the data driver 300 may receive information indicating that data of a current line is equal to data of subsequent plural lines together with pixel data of one horizontal line from the timing controller 400. In this case, the data driver 300 outputs the received pixel data during a duration of the plural lines having the same data. This will be described in detail.

The data driver 300 may be comprised of a plurality of data ICs individually mounted onto circuit films such as COFs so that the data driver 300 may be bonded to the panel 100 by TAB or may be mounted on the panel 100 by a COG method.

Meanwhile, when the panel 100 is an OLED panel, the data driver 300 may further include a sensing unit for sensing current indicating electrical characteristics (e.g., a threshold voltage and mobility of a driving TFT and a threshold voltage of an OLED element) of each subpixel according to control of the timing controller 400, converting the current into digital sensing data, and supplying the digital sensing data to the timing controller 400. The timing controller 400 updates a compensation value of each subpixel using the sensing data of each subpixel received from the data driver 300. The timing controller 400 performs data processing by applying a corresponding compensation value to pixel data to compensate for luminance non-uniformity caused by a characteristic difference between subpixels.

The timing controller 400 and the data driver 300 serially embed clocks in transmission data such as pixel data and data control information and transmit and receive data using a high-speed serial interface for serially transmitting data. For example, the high-speed serial interface includes an embedded point-to-point interface (EPI).

Figure 2:
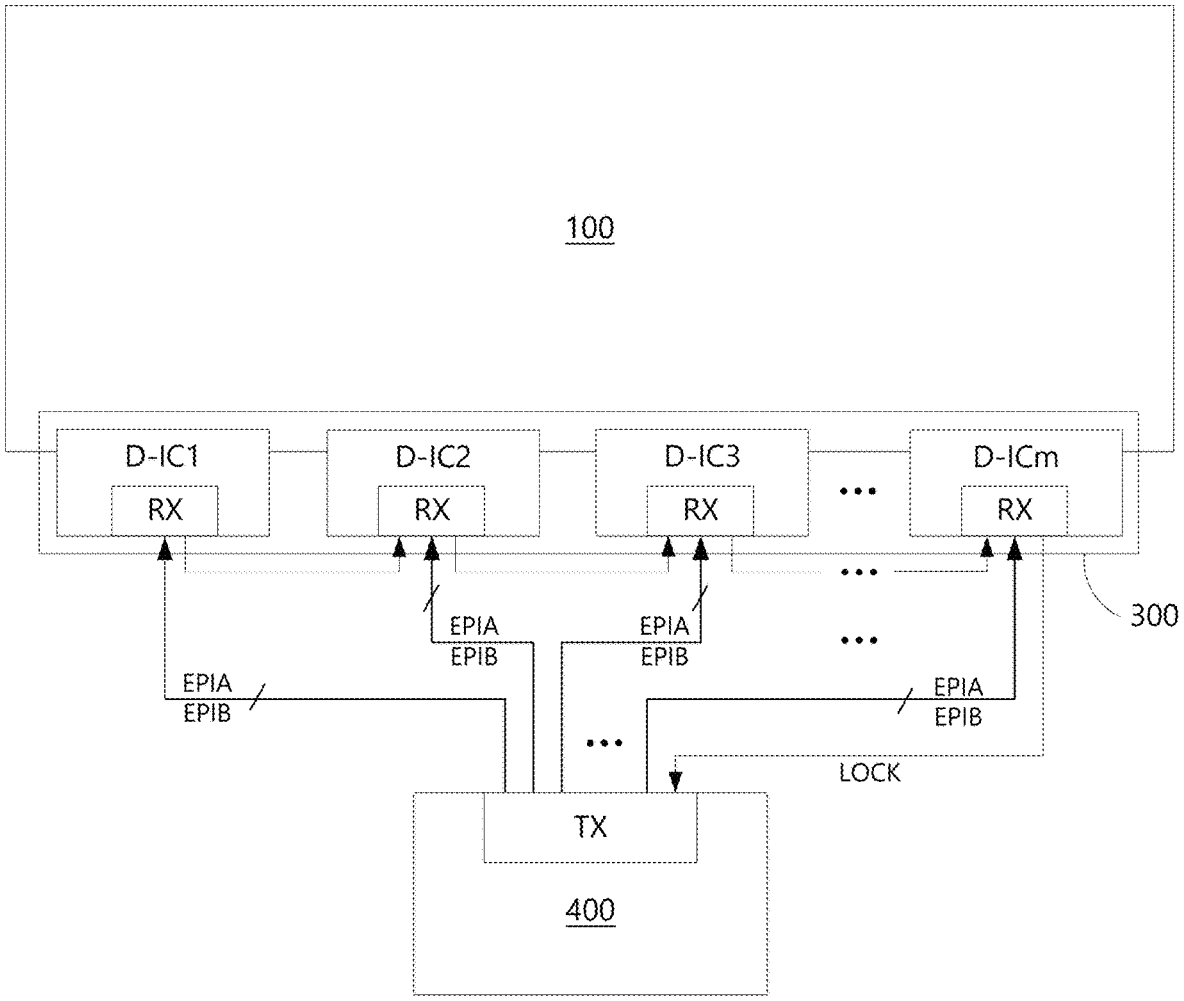
FIG. 2 is a diagram schematically illustrating an interface device including a timing controller and a plurality of data ICs according to an embodiment of the present disclosure.
Figure 3:
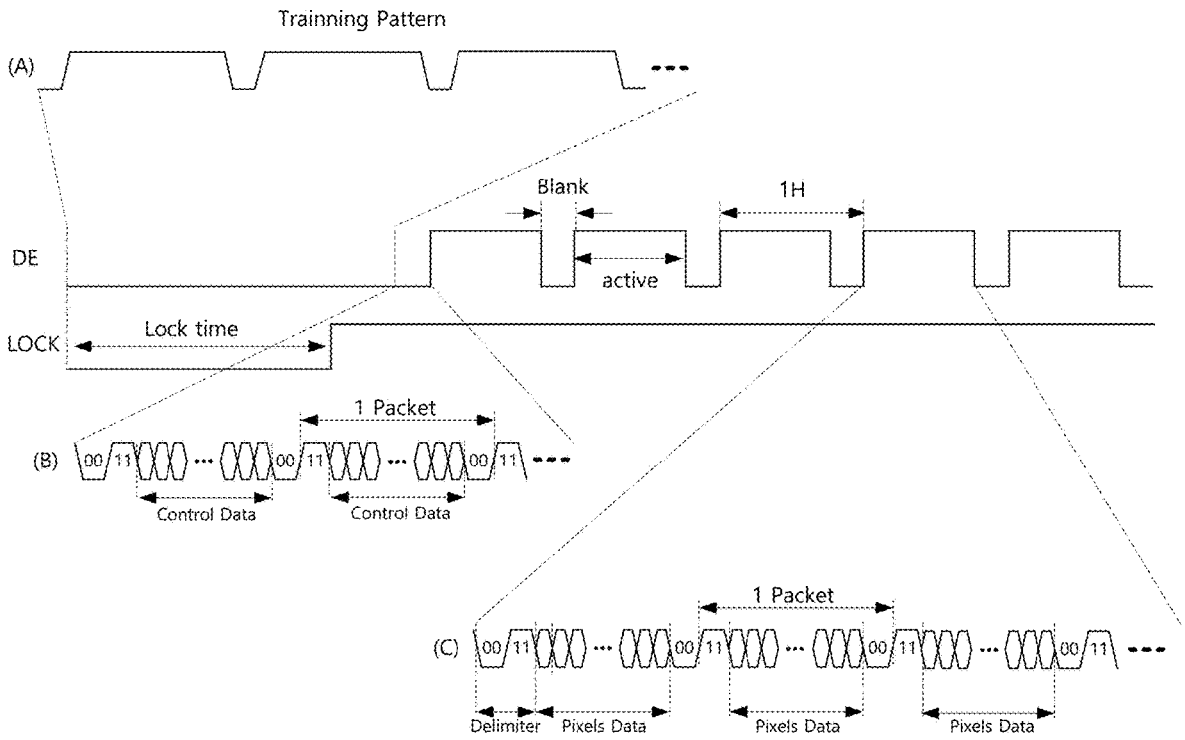
FIG. 3 is a waveform chart illustrating packets transmitted by a timing controller according to an embodiment of the present disclosure.
Figure 4:
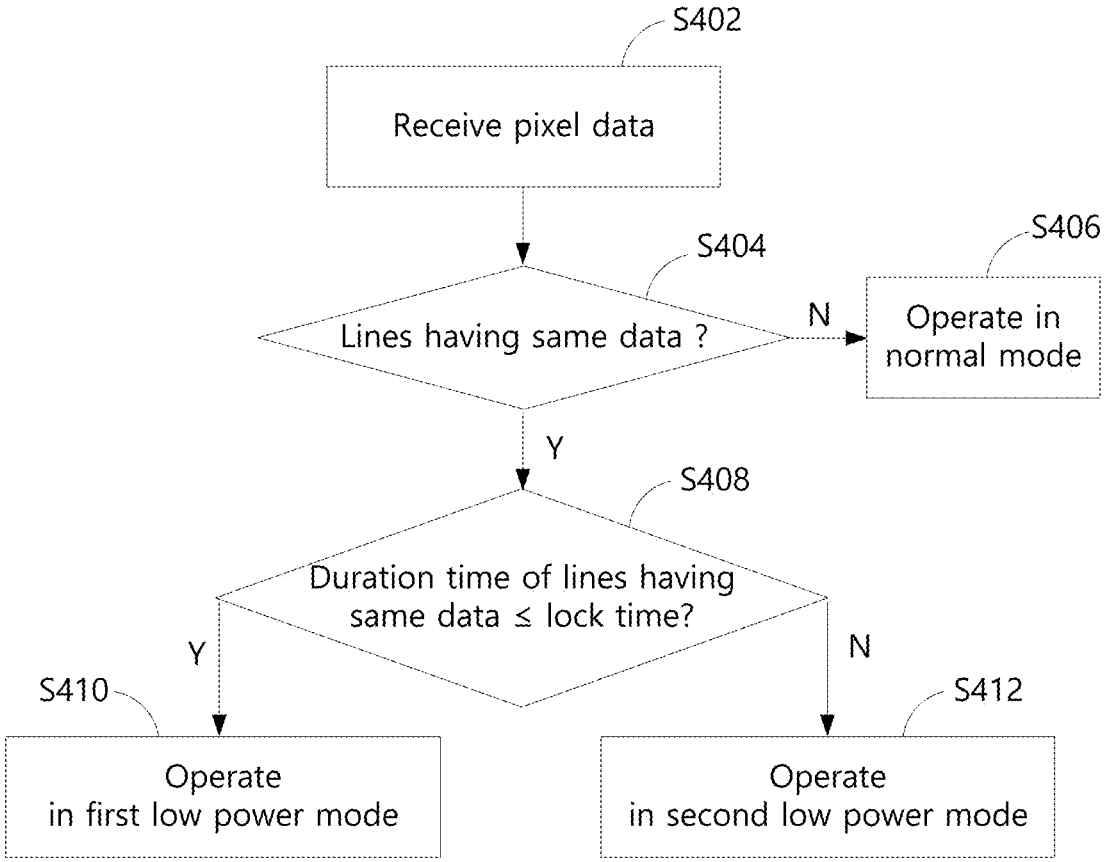
FIG. 4 is a flowchart illustrating a stepwise operation method of a timing controller according to an embodiment of the present disclosure.

FIG. 2 is a diagram illustrating a timing controller and a plurality of data ICs according to an embodiment of the present disclosure. FIG. 3 is a waveform chart illustrating a packet configuration transmitted by a timing controller according to an embodiment of the present disclosure. FIG. 4 is a flowchart illustrating a driving method of a timing controller according to an embodiment of the present disclosure.

Referring to FIG. 2, a data driver 300 includes a plurality of data ICs D-IC1 to D-ICm for dividedly driving data lines of a panel 100. The data ICs D-IC1 to D-ICm are individually connected to a timing controller 400 through a plurality of transmission channels EPIA and EPIB. A transmitter TX configured at an output stage of the timing controller 400 and a receiver RX configured at an input state of each of the data ICs D-IC1 to D-ICm transmit and receive EPI packets through the transmission channels EPIA and EPIB. Each of the transmission channels EPIA and EPIB includes a wiring pair for transmitting the EPI packets in the form of a differential signal.

The transmitter TX of the timing controller 400 converts display information including pixel data and control data into a serial packet including clock edge information, converts the packet into a differential signal type, and transmits the converted packet to the receiver RX of each of the data ICs D-IC1 to D-ICm through the transmission channels EPIA and EPIB.

Referring to FIG. 3, the EPI packets include a training pattern including a clock edge for locking a clock generator of each of the data ICs D-IC1 to D-ICm during initial driving or during a blank time as illustrated in (A), a control packet including a series type of clock edge information and control data as illustrated in (B), and a data packet including a series type of clock edge information and a plurality of pixel data as illustrated in (C). A rising edge of a delimiter indicates the clock edge. The control data includes timing configuration information or logic information for a plurality of data control signals.

If power supply is stabilized during initial driving, the timing controller 400 transmits the training pattern having a predetermined period to the data ICs D-IC1 to D-ICm. The receiver RX of each of the data ICs D-IC1 to D-ICm locks a phase and frequency of a delay locked loop (DLL), which is the clock generator, using the clock edge of the training pattern received from the timing controller 400 and generates an internal clock. If the internal clock is stably locked, the receiver RX of each of the data ICs D-IC1 to D-ICm sequentially outputs a lock signal LOCK to the receiver RX of the next data IC. If the internal clock is locked up to the last data IC D-ICm, the last data IC D-ICm transmits the lock signal LOCK of a high level to the timing controller 400.

If the lock signal LOCK of a high level is supplied by the last data IC D-ICm, the timing controller 400 transmits a control packet to the data ICs D-IC1 to D-ICm during a blank time of a data enable signal DE having one horizontal (1H) period and transmits a data packet to the data ICs D-IC1 to D-ICm during an active time. The receiver RX of each of the data ICs D-IC1 to D-ICm generates the internal clock by extracting the clock edge from the received packet, performs sampling using the internal clock, and restores the control data and the pixel data from the packet. Each of the data ICs D-IC1 to D-ICm generates a plurality of data control signals using the restored control data, converts the pixel data into a pixel data voltage according to the data control signals, and outputs the pixel data voltage to data lines of the panel 100. The data control signals may include a source start pulse, a source shift pulse, a source output enable signal, and a polarity inversion signal.

Particularly, the timing controller 400 compares the input pixel data in horizontal line units to determine whether horizontal lines having the same data are repeated. The timing controller 400 compares an input time of the horizontal lines having the same data with a preset reference time, and stops transmitting repeated data of the horizontal lines having the same data or transmits a training pattern having a low voltage swing level according to the result of comparison, thereby operating in a low power mode for reducing power consumption.

The reference time may be set to a lock time of the data ICs D-IC1 to D-ICm. The lock time means a minimum time from the time when the data ICs D-IC1 to D-ICm are unlocked to the time when the data ICs D-IC1 to D-IC are restored to a lock state by the training pattern transmitted by the timing controller 400 and the lock signal of a high level is received from the last data IC D-ICm.

The data ICs D-IC1 to D-ICm output the same data signal during every horizontal period while a latch unit holds pixel data of the first line among the horizontal lines having the same data, received from the timing controller 400, during a repetitive duration of the same horizontal lines.

Referring to FIG. 4, the timing controller 400 receives pixel data from the system and compares the pixel data in horizontal line units using a line memory to determine whether horizontal lines having the same data are input (steps S402 and S404).

If it is determined that pixel data of a current horizontal line is not equal to pixel data of a previous horizontal line (step S404; N), the timing controller 400 operates in a normal mode (step S406) and transmits the data packet and the control packet to the data ICs D-IC1 to D-ICm as described with reference to FIG. 3.

Meanwhile, if it is determined that the pixel data of the current horizontal line is equal to the pixel data of the previous horizontal line (step S404; Y), the timing controller 400 counts an input time of horizontal lines having the same data and compares the input time with the lock time. The timing controller 400 operates in any one of a first low power mode and a second low power mode according to a duration time of the horizontal lines having the same data as a result of comparison (steps S408, S410, and S412).

Specifically, if the counted duration time of the horizontal lines having the same data is less than or equal to the lock time (S408; Y), the timing controller 400 operates in the first low power mode (S410). Upon operating in the first low power mode, the timing controller 400 transmits the pixel data for the first line among the horizontal lines having the same data and information about a repeated duration of the subsequent horizontal lines having the same data to the data ICs D-IC1 to D-ICm. Thereafter, the timing controller 400 transmits, during the repeated duration of the horizontal lines having the same data, a training pattern having a lower voltage swing level than at least one of normal transmission data and a normal training pattern, instead of the pixel data, thereby reducing power consumption. Since the training pattern is simpler than data, the data ICs D-IC1 to D-ICm may generate a locked internal clock by recognizing the training pattern of a low swing level. For example, the data ICs D-IC1 to D-ICm may maintain a lock state by recognizing the training pattern even when a swing level is reduced by up to 14 mV. While holding pixel data of the first horizontal line stored in the latch unit during a repeated duration of the horizontal lines having the same data, the data ICs D-IC1 to D-ICm repeatedly output the same data during every horizontal period.

Meanwhile, if the counted duration time of the horizontal lines having the same data is greater than the lock time (S408; N), the timing controller 400 operates in the second low power mode (step S412). Upon operating in the second low power mode, the timing controller 400 transmits pixel data for the first line of the horizontal lines having the same data and information about a repeated duration of the subsequent horizontal lines having the same data to the data ICs D-IC1 to D-ICm. Thereafter, the timing controller 400 stops transmitting data by turning off the transmitter TX during a first duration, thereby further reducing power consumption. Next, the timing controller 400 drives the transmitter TX before new data is transmitted after the duration of the horizontal lines having the same data is ended to transmit the training pattern having a low voltage swing level during at least the lock time to the data ICs D-IC1 to D-ICm so that the ICs D-IC1 to D-ICm restore a lock state.

Figure 5:
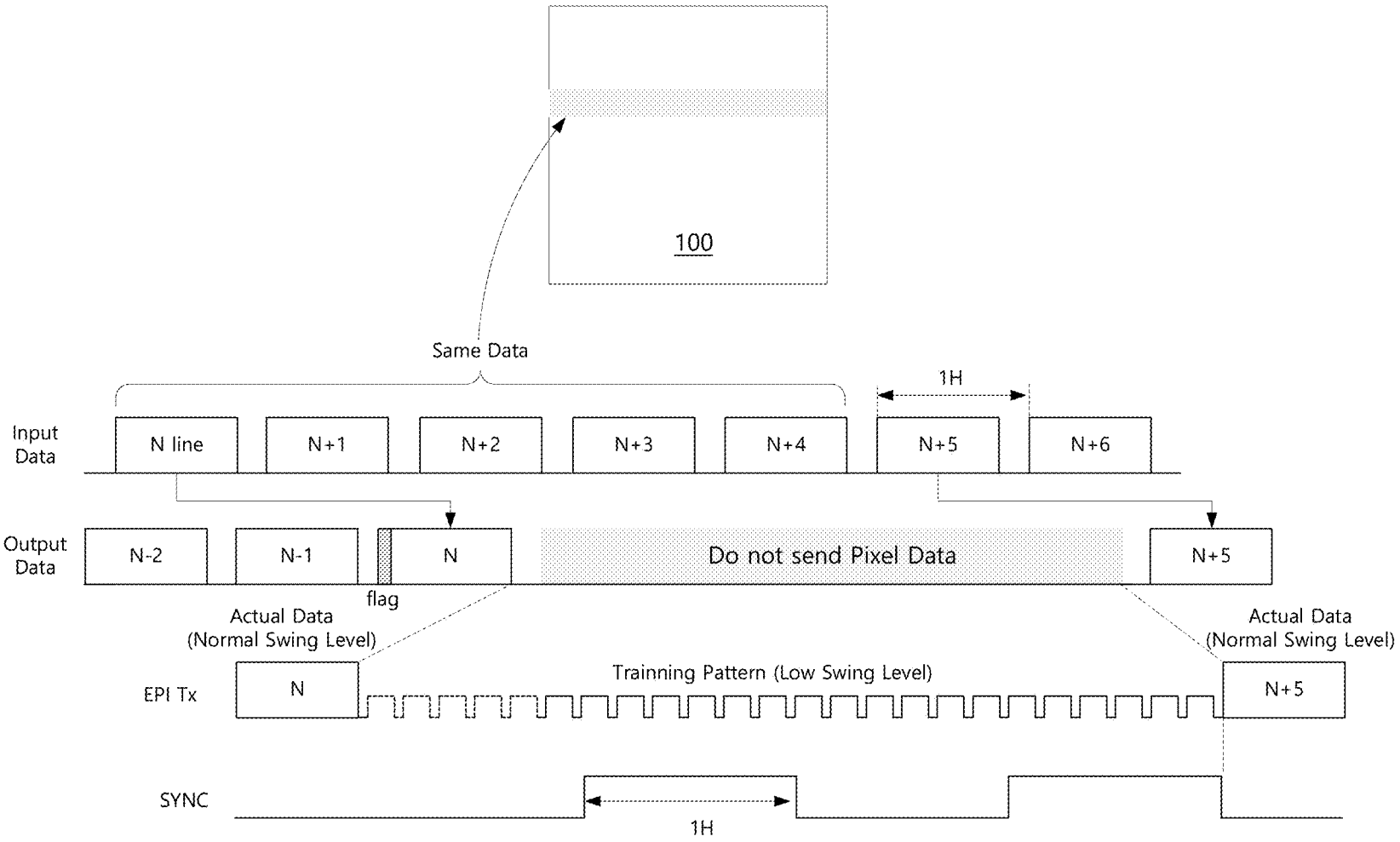
FIG. 5 is a driving waveform chart illustrating an operation of a timing controller in a first low power mode according to an embodiment of the present disclosure.
Figure 6:
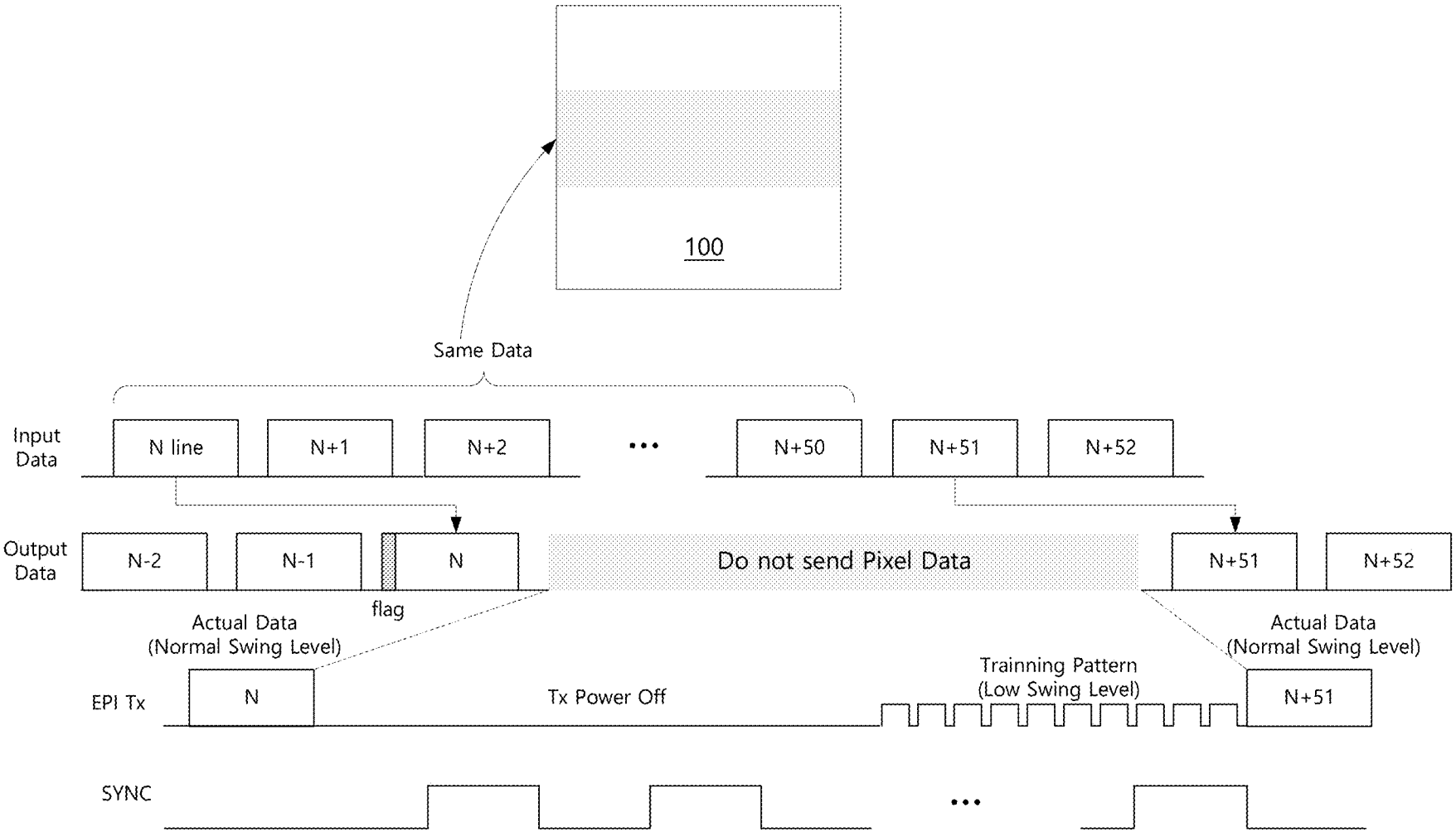
FIG. 6 is a driving waveform chart illustrating an operation of a timing controller in a second low power mode according to an embodiment of the present disclosure.

FIG. 5 is a driving waveform chart illustrating an operation of a first low power mode of a timing controller according to an embodiment of the present disclosure. FIG. 6 is a driving waveform chart illustrating an operation of a second low power mode of a timing controller according to an embodiment of the present disclosure.

Referring to FIGS. 5 and 6, the timing controller 400 receives input data from the system, stores the input data in the line memory, and processes and outputs the data in horizontal line units. The timing controller 400 compares the input data in horizontal line units to determine whether data of an N-th horizontal line is equal to data of an (N+1)-th horizontal line. If it is determined that the data of the N-th horizontal line is equal to the data of the (N+1)-th horizontal line, the timing controller 400 counts the number of horizontal lines having the same data as the data of the N-th horizontal line. That is, the timing controller 400 continues to compare data in horizontal line units and counts the number of the horizontal lines having the same data as data of the N-th horizontal line to check a duration time of the horizontal lines having the same data. The timing controller 400 compares the duration time of the horizontal lines having the same data with a lock time. If the duration time of the horizontal lines having the same data is less than or equal to the lock time, the timing controller 400 operates in the first low power mode as illustrated in FIG. 5. If the duration time of the horizontal lines having the same data is greater than the lock time, the timing controller 400 operates in the second low power mode as illustrated in FIG. 6. If data of the (N+5)-th horizontal line is not equal to data of the (N+4)-th horizontal line, the timing controller 400 processes data in a normal mode and transmits the data to the data ICs D-IC1 to D-ICm.

Referring to FIG. 5, if horizontal lines N+1 to N+4 having the same data as the N-th horizontal line are successively input but a duration time of the horizontal lines is less than the lock time, when the timing controller 400 transmits data of the N-th horizontal line which is the first line of the horizontal lines having the same data, the timing controller 400 transmits a control packet of a blank time to the data ICs D-IC1 to D-ICm. The control packet includes a flag indicating that the horizontal lines having the same data are started and information about a duration during which how many horizontal lines have the same data. Meanwhile, the timing controller 400 may transmit the flag indicating that the horizontal lines having the same data are started to the data ICs D-IC1 to D-ICm using an additional synchronization signal SYNC.

Next, the timing controller 400 stops transmitting data such as a data packet or a control packet during a transmission time corresponding to horizontal lines N+1 to N+4 having the same data as the N-th horizontal line. In this case, the timing controller 400 transmits a training pattern to the data ICs D-IC1 to D-ICm in order to maintain a lock state of the data ICs D-IC1 to D-ICm. The timing controller 400 operates by reducing output current of the transmitter TX to transmit the training pattern having a lower swing level than a voltage swing level used in a normal mode to the data ICs D-IC1 to D-ICm, thereby reducing power consumption.

The data ICs D-IC1 to D-ICm store the data of the N-th horizontal line received from the timing controller 400 in the latch unit and outputs the data. During a repeated duration of the horizontal lines having the same data, the timing controller 400 repeats an operation for outputting the pixel data of the N-th horizontal line stored in the latch unit during every horizontal period during which transition of the synchronization signal SYNC occurs. During the repeated duration of the horizontal lines having the same data, the timing controller 400 generates the synchronization signal SYNC in synchronization with a gate control signal and supplies the synchronization signal SYNC to the data ICs D-IC1 to D-ICm in order to synchronize gate driving signals with outputs of the data ICs D-IC1 to D-ICm.

Referring to FIG. 6, if an input time of horizontal lines N+1 to N+50 having the same data as the N-th horizontal line is greater than the lock time, when the timing controller 400 transmits data of the N-th horizontal line which is the first line of the horizontal lines having the same data, the timing controller 400 includes, in a control packet of a blank time, a flag indicating that the horizontal lines having the same data are started and information about a duration during which how many horizontal lines have the same data and transmits the control packet to the data ICs D-IC1 to D-ICm.

Next, if transmission of the N-th horizontal line is ended, the timing controller 400 turns off power of the transmitter TX during a first duration and stops transmitting data. The data ICs D-IC1 to D-ICm store data of the N-th horizontal line received from the timing controller 400 in the latch unit and output the data. During a repeated duration of horizontal lines having the same data, the timing controller 400 repeats an operation for outputting the pixel data of the N-th horizontal line stored in the latch unit during every horizontal period during which transition of the synchronization signal SYNC occurs. During the first duration during which the transmitter TX of the timing controller 400 is turned off, the receiver of each of the data ICs D-IC1 to D-ICm is also turned off so that power consumption may be further reduced.

To transmit data of the (N+51)-th horizontal line different from data of the (N+50)-th horizontal line, the timing controller 400 turns off power of the transmitter TX during a second duration prior to at least the lock time before the data of the (N+51)-th horizontal line is transmitted and transmits a training pattern of a relatively low swing level to the data ICs D-IC1 to D-ICm, thereby restoring a lock state. If the lock state of the data ICs D-IC1 to D-ICm is restored, the timing controller 400 performs data transmission of the (N+51)-th horizontal line. The timing controller 400 may reduce power consumption in proportion to a duration time of horizontal lines having the same data.

In this way, a display interface device according to an embodiment operates in any one of a first low power mode for transmitting a training pattern of a low swing level according to a duration time of horizontal lines having the same data as a previous horizontal line and a second low power mode including a first duration during which data transmission and reception are stopped and a second duration during which the training pattern is transmitted. Accordingly, since only a minimum signal necessary to drive the panel is maintained, power consumption of the timing controller and the data driver can be reduced.

A display interface device according to an embodiment is applicable to all display devices including an OLED display and an LCD.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

data lines on a substrate;

a plurality of data integrated circuits (ICs) configured to drive the data lines; and a timing controller configured to:

compare an input pixel data in horizontal lines to determine whether a pixel data of an N-th horizontal line is equal to a pixel data of an (N+1)-th horizontal line, if it is determined that the pixel data of the N-th horizontal line and the pixel data of the (N+1)-th horizontal line are the same, transmit the pixel data for a first horizontal line among the horizontal lines having the same pixel data and stop transmitting the pixel data for the other horizontal lines, thereby operating in a low power mode;

wherein, when the timing controller operates in the low power mode, the timing controller is configured to count an input time of the horizontal lines having the same pixel data and compare the input time with a reference time, wherein, when the counted input time is greater than the reference time, the timing controller is configured to transmit the pixel data of the first horizontal line to at least one of the plurality of data ICs, thereafter, stop transmitting the pixel data during a first duration and transmit a training pattern during a second duration, corresponding to the other horizontal lines among the horizontal lines having the same pixel data.

2. The display device of claim 1, wherein a voltage swing level of the training pattern transmitted in the low power mode is lower than a voltage swing level of a normal operation mode.

3. The display device of claim 1, wherein, when the timing controller operates in the low power mode, the timing controller is configured to transmit a flag indicating with the pixel data of the first horizontal line.

4. The display device of claim 1, wherein at least one of the plurality of data ICs is configured to output the pixel data of the first horizontal line received from the timing controller stored in a latch unit, thereafter output the stored pixel data of the first horizontal line for remaining horizontal lines having the same pixel data.

5. A display device comprising:

data lines on a substrate;

a plurality of data integrated circuits (ICs) configured to drive the data lines; and a timing controller configured to:

compare an input pixel data in horizontal lines to determine whether a pixel data of an N-th horizontal line is equal to a pixel data of an (N+1)-th horizontal line, if it is determined that the pixel data of the N-th horizontal line and the pixel data of the (N+1)-th horizontal line are the same, transmit the pixel data for a first horizontal line among the horizontal lines having the same pixel data and stop transmitting the pixel data for the other horizontal lines, thereby operating in a low power mode;

wherein, when the timing controller operates in the low power mode, the timing controller is configured to count an input time of the horizontal lines having the same pixel data and compares the input time with a reference time, wherein, when the counted input time is less than or equal to the reference time, the timing controller is configured to transmit the pixel data of the first horizontal line to at least one of the plurality of data ICs, thereafter, transmit a training pattern during a transmission duration, corresponding to the other horizontal lines among the horizontal lines having the same pixel data.

6. The display device of claim 5, wherein a voltage swing level of the training pattern transmitted in the low power mode is lower than a voltage swing level of a normal operation mode.

7. The display device of claim 5, wherein, when the timing controller operates in the low power mode, the timing controller is configured to transmit a flag indicating the pixel data of the first horizontal line.

8. The display device of claim 5, wherein at least one of the plurality of data ICs is configured to output the pixel data of the first horizontal line received from the timing controller stored in a latch unit, thereafter output the stored pixel data of the first horizontal line for remaining horizontal lines having the same pixel data.

9. A method of driving a display device comprising:

driving a plurality of data lines using a plurality of data integrated circuits;

comparing an input pixel data being driven to respective horizontal lines in the display;

determining whether a pixel data of an N-th horizontal line is equal to a pixel data of an (N+1)-th horizontal line using a timing controller;

stop transmitting the pixel data for the other horizontal lines and entering a low power operation mode if it is determined that the pixel data of the N-th horizontal line and the pixel data of the (N+1)-th horizontal line are the same, transmitting the pixel data for a first horizontal line among the horizontal lines having the same pixel data;

counting, when the timing controller operates in the low power mode, an input time of the horizontal lines having the same pixel data;

comparing the input time with a reference time; and stop transmitting the pixel data during a first duration and transmit a training pattern during a second duration, corresponding to the other horizontal lines among the horizontal lines having the same pixel data, when the counted input time is greater than the reference time.

10. The method according to claim 9 further comprising:

transmitting a training pattern during a transmission duration, corresponding to the other horizontal lines among the horizontal lines having the same pixel data.

11. The method according to claim 9 further comprising:

outputting the pixel data of the first horizontal line received from the timing controller to a latch unit; and storing the pixel data of the first horizontal line for remaining horizontal lines having the same pixel data.

* * * * *